United States Patent [19]

Chang

[11] Patent Number: 4,769,861

[45] Date of Patent: Sep. 13, 1988

[54] AUTOMATIC HAIR-WASHING MACHINE

[76] Inventor: Yu-Lung Chang, P.O. Box 10160, Taipei, Taiwan

[21] Appl. No.: 82,449

[22] Filed: Aug. 6, 1987

[51] Int. Cl.[4] ..... A45D 19/00

[52] U.S. Cl. ..... 4/515; 4/516; 4/518

[58] Field of Search ..... 4/515–523; 128/65, 66, 56

[56] References Cited

U.S. PATENT DOCUMENTS

| | | | |
|---|---|---|---|
| 379,646 | 3/1888 | Heinemann | 4/515 |
| 998,804 | 7/1911 | Salisbury | 4/518 |
| 2,854,969 | 10/1958 | Nolan | 4/518 X |
| 2,856,918 | 10/1958 | Kingery et al. | 4/518 X |
| 2,914,066 | 11/1959 | Crow | 4/518 X |
| 3,343,530 | 9/1967 | Solos et al. | 4/518 X |
| 3,416,517 | 12/1968 | Adam et al. | 4/516 X |
| 3,732,580 | 5/1973 | Fava | 4/518 |
| 4,078,557 | 3/1978 | Spencer | 4/518 X |

*Primary Examiner*—Henry K. Artis

[57] ABSTRACT

An automatic hair-washing machine includes an outer shell, an inner shell disposed around a user's skull and hair, a plurality of rubbing rods secured between the two shells and poking inwardly through the inner shell to touch the user's hair and two driving motors for vertically and horizontally reciprocating the two shells and the rods for twisting, rubbing and washing the user's hair as flushed by water and shampoo delivered by a hose through the two shells.

6 Claims, 3 Drawing Sheets

AUTOMATIC HAIR-WASHING MACHINE

BACKGROUND OF THE INVENTION

For washing a human's hair, it is always done by manual operation. If someone who does not like to wash his hair by himself, he may go to a barber shop to have his hair washed by a barber or a barber assistant. However, the barber or the barber assistant may be susceptible to chemical corrosion or pollutants contamination by shampoo or washing liquid to cause occupational disease. Meanwhile, to wash hair by hands may increase labour cost, which is unsuitable in modern business management.

It is therefore expected by the present inventor to invent the present automatic hair-washing machine.

SUMMARY OF THE INVENTION

The object of the present invention is to provide an automatic hair-washing machine including: an outer shell, an inner shell snugly fastened on a human's skull, a plurality of rubbing rods operatively rubbing the human's hair for rinsing and washing his or her hair and a twisting actuator driving the plural rubbing rods reciprocatively either vertically or horizontally for thoroughly washing the human's hair.

BRIEF DESCRIPTION OF THE DRDAWINGS

DETAILED DESCRIPTION

Figure 1:
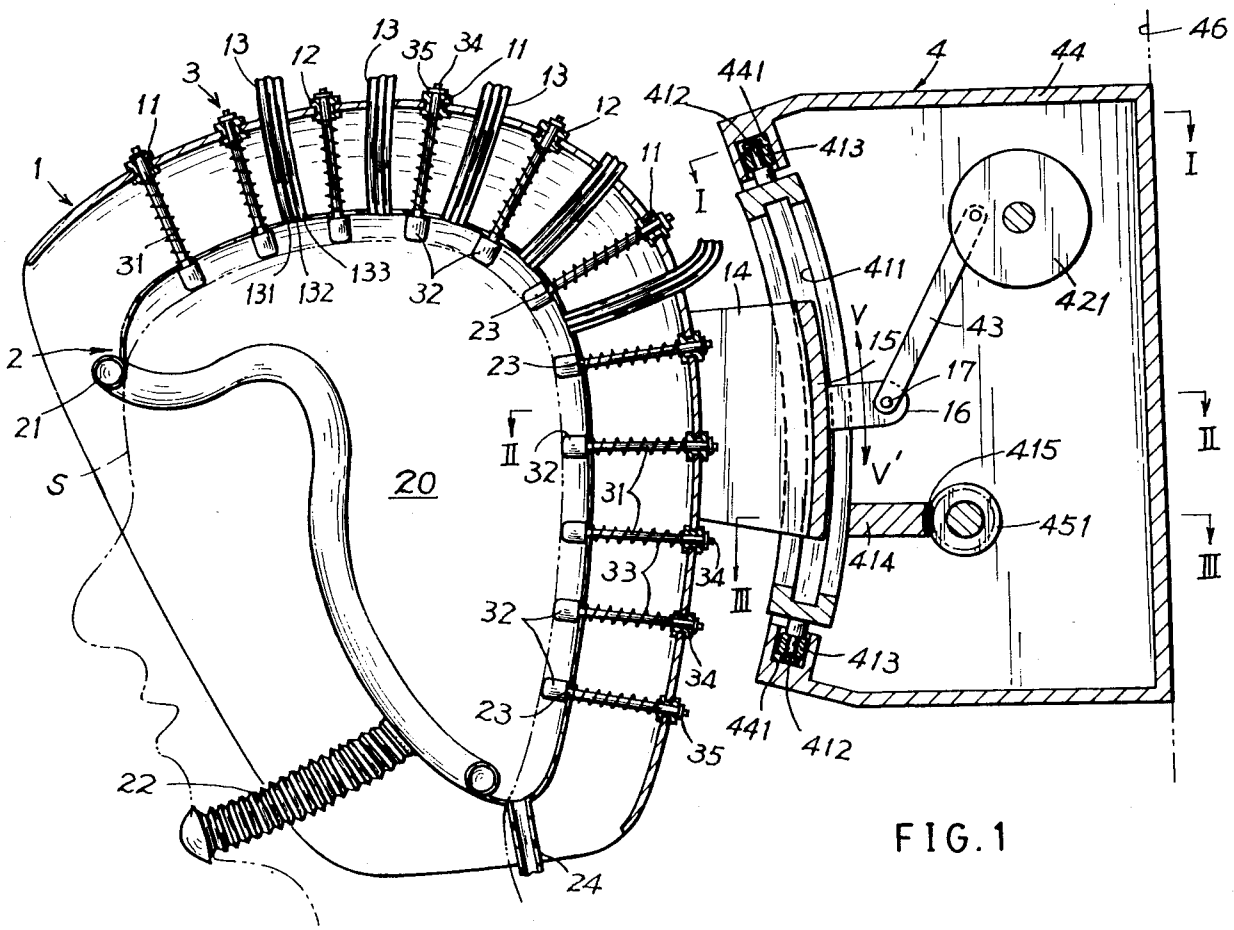
FIG. 1 is a sectional drawing of the present invention.
Figure 2:
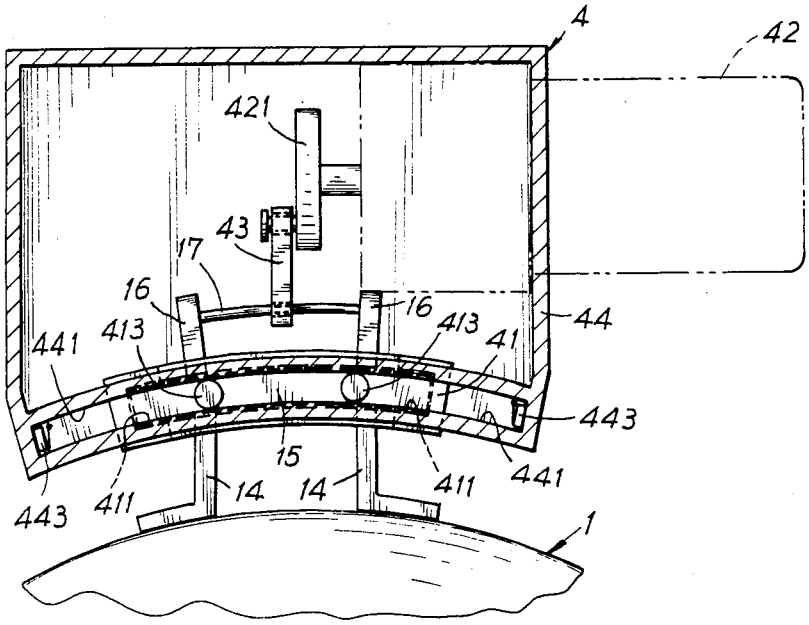
FIG. 2 is a sectional drawing of the present invention when viewed from I—I direction of FIG. 1.
Figure 3:
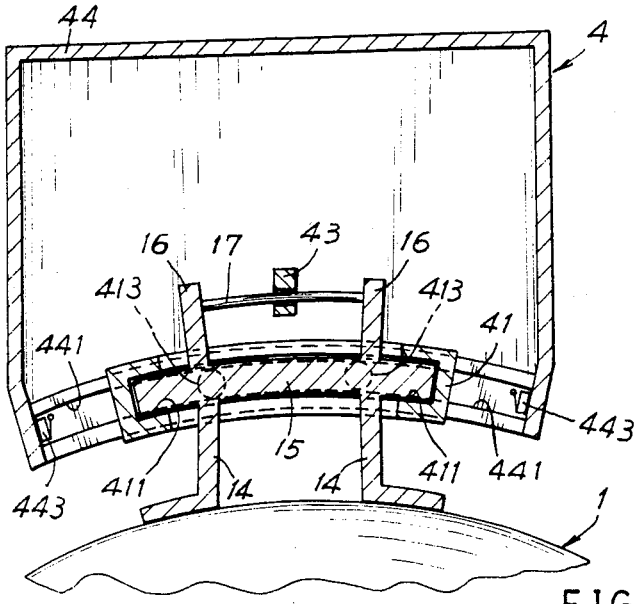
FIG. 3 is a sectional drawing of the present invention when viewed from II—II direction of FIG. 1.
Figure 4:
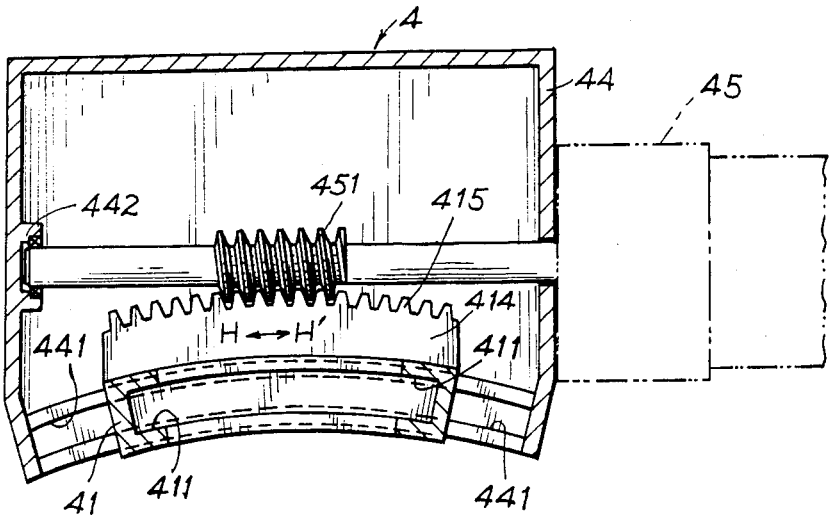
FIG. 4 is a sectional drawing of the present invention when viewed from III—III direction of FIG. 1.

As shown in FIGS. 1-4, the present invention comprises: an outer shell 1, an inner sheel 2, a plurality of rubbing rods 3, and a twisting actuator 4.

The outer shell 1 is formed with a plurality of rod holes 11 each hole 11 inserted with a cylinder 12 adapted for mounting each rubbing rod 31 in the cylinder 12, several triple-tube hoses 13 each directing through the outer shell 1 toward the inner shell 2 fluidically communicated with a washing chamber 20 defined within the inner shell 2, and a bracket 14 connected with an arcuate plate 15 secured to a rear portion of the outer shell 1. The triple-tube hose 13 includes a first tube 131 for supplying water into the inner shell 2, a second tube 132 for delivering a shampoo or washing liquid into shell 2 and a third tube 133 for blowing warm or hot air into shell 2 for drying the washed hair.

The inner shell 2 is formed as a flexible elastic thin -plate cap snugly disposed around a human's skull S having hair born thereon and smaller than the outer shell 1 and includes: an inflatable hose 21 formed on a front rim of the shell 2 adapted for sealing a human's hair within the shell 2 along a contour of a human's forehead, cheek and nape of neck portion, an elastic fastener 22 secured on the lower portion of shell 2 adapted for fastening on a user's chin, a plurality of rod holes 23 passing the rubbing rods 3 therethrough, and a discharge hose 24 formed on the lower portion of the shell 2 adapted for discharging waste water, liquid or air from the washing chamber 20. The inflatable hose 21 may be further embedded in a rigid frame (not shown) formed on the front rim of the inner shell 2 to ensure the well sealing of the hose 21 on a user's head.

Each rubbing rod 3 includes: a rod 31 having its innermost end mounted with a rubbing block 32 made from rubber or other elastomers and having its outer end 34 inserted in a cylinder 12 formed on the outer shell 1 as retained by a retainer 35, and a restoring spring 33 jacketed on the rod 31 defined between the two shells 2, 1 to resiliently extend the rubbing block 32 and the inner shell 2 inwardly for touching a human's hair. The outer end 34 of rod 31 may be threaded to be engageable with a screw hole formed inside each cylinder 12 (not shown) so that the rod 31 can be adjusted for poking the block 32 inwardly.

The twisting actuator 4 includes a casing 44 mounted on a fixture 46, an arcuate slide frame 41 horizontally reciprocatively formed on a front portion of the actuator 4, a vertically reciprocating (first driving motor 42 mounted on the casing 44, and a horizontally reciprocating (second) driving motor 45 mounted on the casing 44.

The arcuate slide frame 41 is formed with a pair of upper rollers 413 rotatably mounted on a pair of pins 412 formed on a top end of the frame 41 horizontally rotatably moving in a horizontal arcuate groove 441 formed on the front edge of the casing 44, and a pair of lower rollers 413 rotatably mounted on a pair of pins 412 formed on a lower end of the frame 41 rotatably moving in an arcuate groove 441 formed on the front edge of the casing 44. A sector 414 having a toothed edge 415 engageable with a worm 451 formed on a driving shaft of the motor 45 so that upon the driving of the motor 45, the frame 41 will be horizontally reciprocated along the grooves 441. The worm 451 has it outer end pivotally mounted on socket 442 formed on a casing wall.

The frame 41 is vertically formed with a vertical arcuate groove 411 for slidably engaging the arcuate plate 15 as secured to the outer shell 1 therein. The arcuate plate 15 is formed with a pair of lugs 16 protruding rearwardly and transversely linked with an arcuate shaft 17 to pivotally connect one end of a link 43 of which the other end is pivotally secured to an eccentric wheel 421 mounted on a driving shaft of the vertically reciprocating motor 42.

When using the present invention as shown in FIG. 1, the inner shell 2 is snugly mounted on a user's head S and the inflatable hose 21 is filled with air to well seal the user's head and the fastener 22 is fastened to his or her chin. The water is delivered through first tube 131 and shampoo is delivered through second tube 132 to the washing chamber 20. The motor 42 is started to rotate the eccentric wheel 421 to eccentrically move the link 43 to reciprocate the arcuate plate 15 vertically (V V') so as to twist the shells 1, 2 and the rods 3 vertically, whereby the plural rubbing blocks 32 will vertically rub and twist the user's hair as flushed by water and shampoo delivered from hose 13. Meanwhile, the motor 45 is also operated to rotate the worm 451 to horizontally reciprocate (H H') the sector 414, the frame 41, the engaged arcuate plate 15 and the shells 1, 2 so as to rub the hair horizontally, in commensuration with the vertical reciprocating washing operation as driven by the motor 42. The waste water and shampoo will be drained through discharge hose 24. The hot air can then be directed into washing chamber 20 through third tube 133 for drying the washed hair. The horizontal movement (H H') does not conflict the vertical movement (V V') since the arcuate shaft 17 is pivotally secured to link 43.

The motors 42, 45 each can be a speed-reduced motor to be suitable for hair-washing operation. The triple-tube hose 13 can also be separated into three individual tubes to deliver water, shampoo, or air respectively. The fixture 46 can also be designed for universally adjusting the pose of the present invention (not shown). Two micro-switches 443 are formed on both ends of the horizontal groove 441 to control the forward/reverse of the motor 45, adapted for horizontally reciprocating the sector 414 and frame 41.

Accordingly, the present invention can be used to wash a user's hair automatically to have the following advantages:

1. The hair is automatically washed to save cost, time and to increase convenience and comfortableness for hair-washing.

2. Hair-washing is done in the washing chamber as sealed in the inner shell 2 so that the washing liquid will not cause contamination to a user's clothes and fingers.

3. Due to the rubbing movement by the plural rods 31, a user's head can also be massaged or be scratched for his or her itching.

I claim:

1. An automatic hair-washing machine comprising:

an outer shell having a plurality of holes formed thereon, a bracket connected with an arcuate plate secured to a rear portion of said outer shell;

an inner shell, formed as a flexible elastic thin-plate cap adapted to be snugly disposed around a human's skull having hair born thereon and smaller than said outer shell, which includes an inflatable hose formed on a front rim of said inner shell adapted for sealing a human's hair within said inner shell along a contour of a human's forehead, cheek and nape of the neck portion, an elastic fastener secured on the lower portion of said inner shell for fastening on a human's chin, a plurality of holes formed on the inner shell corresponding to said holes on said outer shell, and a discharge hose formed on the lower portion of said inner shell, a plurality of tubes for respectively directing water, shampoo and hot air through said outer shell into said inner shell;

a plurality of rubbing rods each, including a rod having its innermost end mounted with a rubbing block made from rubber or other elastomers and having its outer end inserted into said hole on said outer shell, a restoring spring jacketed on said rod defined between said two shells to resiliently extend said rubbing block and said inner shell inwardly; and a twisting actuator including a casing mounted on a fixture, an arcuate side frame horizontally reciprocatively formed on a front portion of said casing having a vertical arcuate groove formed thereon for vertically reciprocatively engaging said arcuate plate of said outer shell, a first driving motor having an eccentric wheel pivotally connected with a link pivotally connected with an arcuate shaft transversely linked between two lugs protruding rearwardly from the arcuate plate for vertically reciprocatively moving said arcuate plate and said shells, and a second driving motor having a worm engageable with a sector protruding rearwardly from said arcuate slide frame for horizontally reciprocatively moving said slide frame, said arcuate plate engaged in said frame and said shells, whereby upon the applying of water and shampoo into said inner shell and running of both said motors, said shells and said rubbing rods will be reciprocated either vertically or horizontally to rub and wash the human's hair automatically.

2. A hair-washing machine according to claim 1, wherein said arcuate slide frame has two pairs of rollers rotatably mounted on the top and bottom ends thereof and horizontally slidably engaged with two horizontal arcuate grooves formed on the front edges of said casing of said actuator.

3. A hair-washing machine according to claim 1, wherein each said respective rubbing rod is adjustably mounted in said hole of said outer shell.

4. A hair-washing machine according to claim 1, wherein a washing chamber is defined within said inner shell and said inflatable hose formed on a front rim of said inner shell and the head of a user.

5. A hair-washing machine according to claim 1, wherein two micro-switches are provided on both ends of the horizontal groove of said casing, adapted for controlling the forward/reverse rotation of said second driving motor for horizontally reciprocating said sector, said slide frame and said shells.

6. A hair-washing machine according to claim 1, wherein said inflatable hose is embedded in a rigid frame secured to the front rim of said inner shell.

* * * * *